US005374066A

United States Patent [19]

Ali

[11] Patent Number: 5,374,066

[45] Date of Patent: Dec. 20, 1994

[54] U.S. PRESIDENTIAL ELECTION GAME AND METHOD OF PLAYING

[76] Inventor: Abdulkadir H. Ali, 4439 S. 31st St., #103, Arlington, Va. 22206

[21] Appl. No.: 235,631

[22] Filed: Apr. 29, 1994

[51] Int. Cl.[5] ..... A63F 3/00

[52] U.S. Cl. ..... 273/279; 273/146

[58] Field of Search ..... 273/242, 243, 248, 249, 273/257, 279, 146

[56] References Cited

U.S. PATENT DOCUMENTS

| | | | |
|---|---|---|---|
| 391,715 | 10/1888 | Kellogg | 273/257 X |
| 690,273 | 12/1901 | Hambrick | 273/257 |
| 3,368,816 | 2/1968 | Milazo et al. | 273/257 |
| 3,512,779 | 5/1970 | McGaughey, Jr. | 273/279 |
| 4,085,938 | 4/1978 | Bean, Jr. | 273/279 |
| 4,092,028 | 5/1978 | Marse | 273/257 X |
| 4,216,967 | 8/1980 | Marse | 273/257 |
| 4,682,778 | 7/1987 | Willis et al. | 273/146 X |
| 5,288,076 | 2/1994 | Jackson et al. | 273/279 |

FOREIGN PATENT DOCUMENTS

| | | | |
|---|---|---|---|
| 2363346 | 3/1978 | France | 273/279 |
| 2493164 | 5/1982 | France | 273/257 |

*Primary Examiner*—William E. Stoll

*Attorney, Agent, or Firm*—Wigman, Cohen, Leitner & Myers

[57] ABSTRACT

An educational and recreational game and method of playing thereof emulates the presidential election process in the U.S.A. Each of the 51 voting jurisdictions is assigned a representative number of electoral votes. Voting for each state follows an ordered path starting in Maine and following a serpentine path through and including 48 additional states and the District of Columbia and concluding in California. Each player or team of players, representing a major political party, Democratic, Republican, Independent, rolls a dice having faces marked with differing percentages of the popular vote to determine a win or loss of the popular and electoral votes for each state. Play continues until one team amasses at least 270 electoral votes necessary to win the election and place its candidate in the White House.

10 Claims, 3 Drawing Sheets

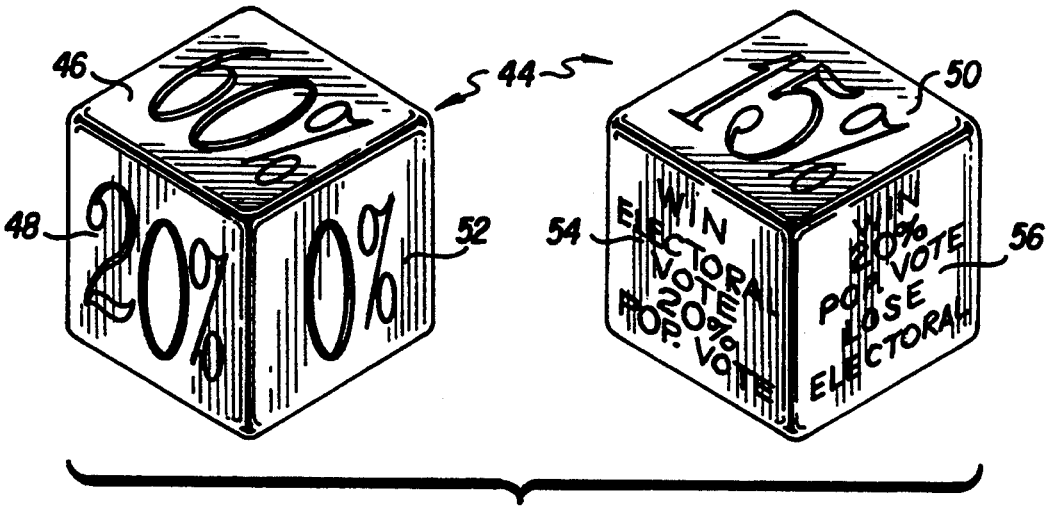
FIG. 2
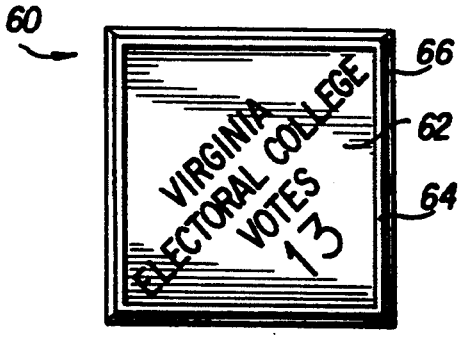
FIG. 3
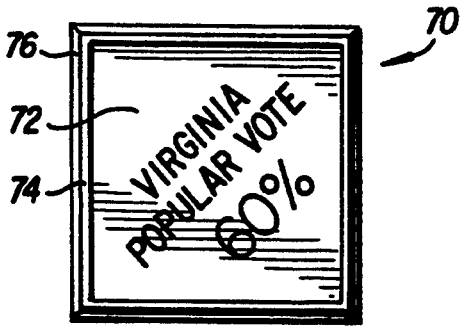
FIG. 4
FIG. 5
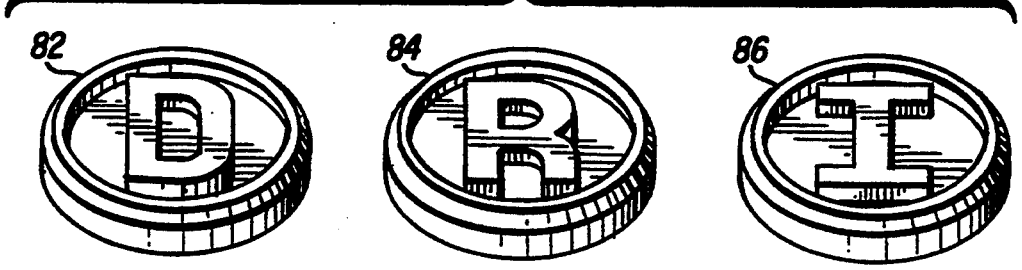

FIG. 6

STATES AND ELECTORAL COLLEGE VOTES

| | | | |
|---|---|---|---|
| Alabama | 9 | Alaska | 3 |
| Arizona | 8 | Arkansas | 6 |
| California | 54 | Colorado | 8 |
| Connecticut | 8 | Delaware | 3 |
| Florida | 25 | Georgia | 13 |
| Hawaii | 4 | Idaho | 4 |
| Illinois | 22 | Indiana | 12 |
| Iowa | 7 | Kansas | 6 |
| Kentucky | 8 | Louisiana | 9 |
| Maine | 4 | Maryland | 10 |
| Massachusetts | 12 | Michigan | 18 |
| Minnesota | 10 | Mississippi | 7 |
| Missouri | 11 | Montana | 3 |
| Nebraska | 5 | Nevada | 4 |
| New Hampshire | 4 | New Jersey | 15 |
| New Mexico | 5 | New York | 33 |
| North Carolina | 14 | North Dakota | 3 |
| Ohio | 21 | Oklahoma | 8 |
| Oregon | 7 | Pennsylvania | 23 |
| Rhode Island | 4 | South Carolina | 8 |
| South Dakota | 3 | Tennessee | 11 |
| Texas | 32 | Utah | 5 |
| Vermont | 3 | Virginia | 13 |
| Washington | 11 | West Virginia | 5 |
| Wisconsin | 11 | Wyoming | 3 |
| District of Columbia | 3 | | |

U.S. PRESIDENTIAL ELECTION GAME AND METHOD OF PLAYING

FIELD OF THE INVENTION

The present invention relates to a method of playing a board game, and more particularly to a method of playing an educational and recreational board game which emulates the democratic presidential election process in the United States of America.

BACKGROUND OF THE INVENTION

The Presidency of the United States of America is a democratically elected position which is won by an eligible candidate who successfully competes in a quadrennial national election. Generally, each of the three major political parties, including the Democratic, Republican and Independent parties, endorses and sponsors a presidential candidate at partisan caucuses held prior to the election. Although the majority of the American voting public typically votes for a candidate from one of the three major parties, additional candidates which may include one of the major party candidates may be endorsed and/or sponsored by one or more minor political parties.

According to the presidential election process, a candidate must accumulate a majority share of electoral college votes to succeed to the Office of the President. The only other elective federal official not elected by direct, i.e., popular, vote is the Office of the Vice President. Every fourth year, each state chooses as many electors to the Electoral College as it has senators and representatives in Congress. There are 100 senators and 435 representatives, which when added to the three electors representing the District of Columbia as provided by the 23rd Amendment to the Constitution, totals 538 members of the Electoral College. Of this number, 270 electoral votes, i.e., a majority vote, are needed to elect the president and vice-president. The voting decisions of the electors may be based on the outcome or trend of a popular vote which is tallied in each state. However, the outcome of the electoral college vote may not necessarily reflect the outcome of the popular vote, which includes all of those votes tallied and reported by each state. Moreover, reporting of the near-final popular vote generally occurs during the evening hours of Election Day, that reporting generally being chronologically staggered from the eastern part of the country to the western part of the country.

It is a common misunderstanding that a majority popular vote for a particular candidate determines the ultimate outcome of the election, when in fact, it is the final electoral college vote that actually determines the successful candidate, which may be different from the candidate who won the popular vote. Also, both the popular vote and the electoral college vote may be swayed by changes in voting patterns based on news media-generated projections and predictions as individual state popular votes are tallied and reported to the public prior to the time the polls are closed.

Accordingly, the U.S. presidential election process has been found to be confusing, complex and difficult to comprehend by many people who are being newly acquainted or reacquainted with the election process each quadrennial election year or who are studying the political process of the United States of America. In particular, there is a special need for providing this education to recent immigrants who are preparing for naturalization and students who are studying the American political process.

SUMMARY OF THE INVENTION

In view of the foregoing, it is apparent that there exists a need for a teaching aid for teaching the democratic presidential election process in a manner which augments and complements a formal course of instruction.

It is therefore an object of the present invention to provide a method of teaching the democratic presidential election process in the United States of America.

It is another object of the present invention to provide a method of playing an educational and recreational board game which emulates the democratic presidential election process in the United States of America.

The present invention provides a game to be played by a plurality of players, each player representing one of the three major political parties, i.e., Democratic, Republican (G.O.P.) and Independent parties. The game board depicts the geographical boundaries of the United States of America and the fifty states and the District of Columbia thereof, each of which is represented in the presidential election. The game emulates the actual number of electoral votes cast for each state and the District of Columbia. The game board includes a predetermined play path which simulates the reporting of popular votes from the eastern to the western portions of the U.S.A., as indicated by an arrow passing through each state, starting with the state of Maine and ending with the state of California. Each player or team of players rolls a dice having six sides each representing a proportion of the popular vote won in the instant state election, or a combination win and/or loss of the electoral vote and/or popular vote. The player having the higher roll, i.e. winning the popular vote in that state, receives and retains a popular vote card and an electoral vote card. The game board has card receiving regions assigned to each of the three major political parties for receiving the playing cards accumulated by each party. The voting is tallied and retallied as each state election is waged by the rolling of the dice along the predetermined pattern of play. The first player or team to accumulate at least 270 electoral college votes wins the game, and thereby wins the White House.

With the foregoing and other objects, advantages and features of the present invention that will become hereinafter apparent, the nature of the invention may be more clearly understood by reference to the following detailed description of the invention, the appended claims, and to the several views illustrated in the attached drawings.

BRIEF DESCRIPTION OF THE DRAWINGS

FIG. 2 is a perspective view of a playing die each side thereof being marked with a percentage value of the electoral vote, or a message indicating an alternative outcome;

FIG. 3 is a perspective view of an exemplary game scoring piece showing a representative electoral college vote for a selected state;

FIG. 4 is a perspective view of an exemplary game scoring piece representing the winning accumulation of the popular vote for a selected state;

FIG. 5 is a top plan view of a set of three game pieces each showing a symbol representative of a major political party; and FIG. 6 is a chart listing the number of electoral college votes assigned to each state and competed for by each player.

DETAILED DESCRIPTION OF THE INVENTION

Figure 1:
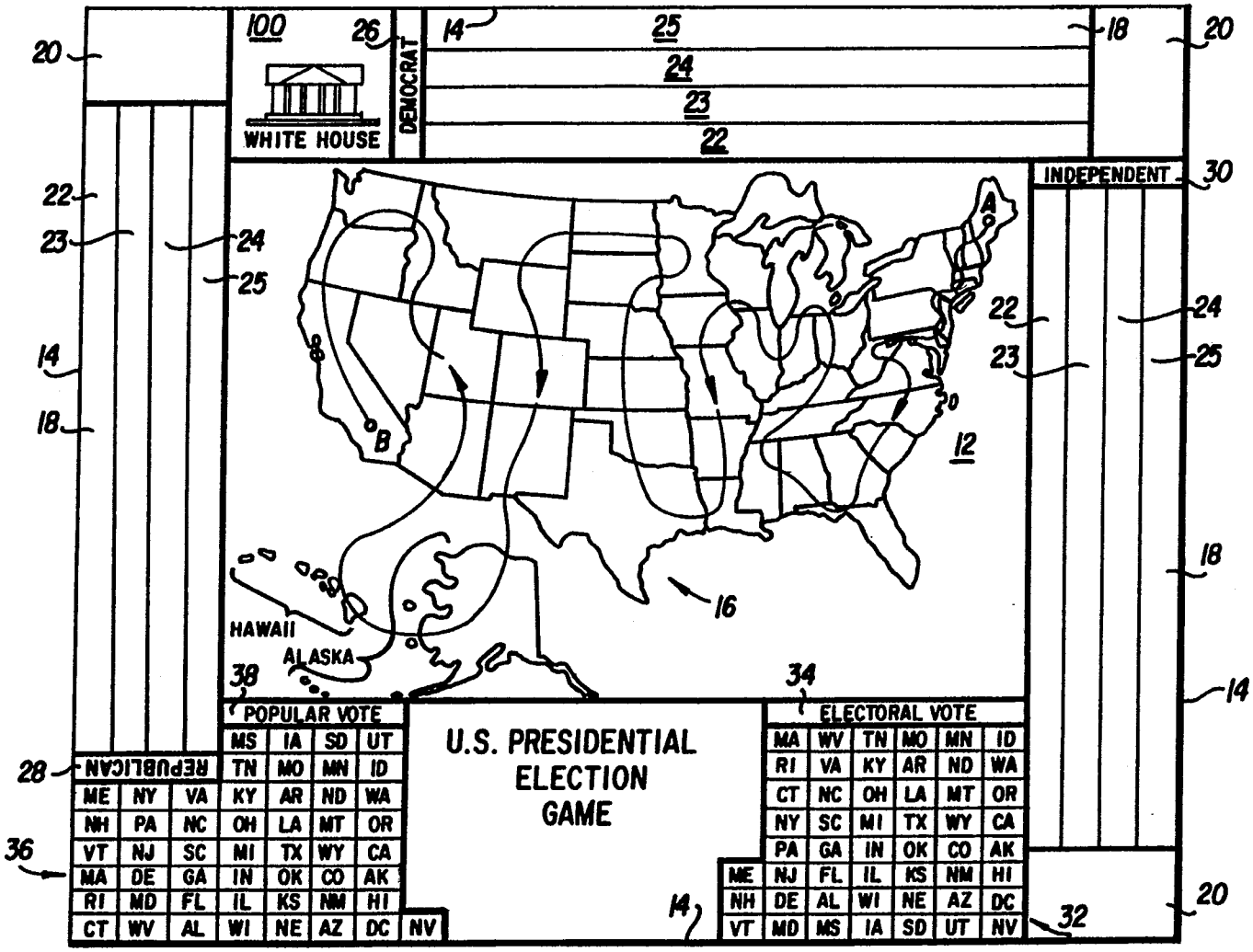
FIG. 1 is a top plan view of the presidential election game of the present invention, showing a game playing board depicting the United States of America and each of the fifty states and the District of Columbia, the playing board further including designated regions for receiving game cards representing a popular vote and an electoral vote amassed by each political party as it passes through each state during the course of play.

Referring now in detail to the drawings wherein like parts are designated by like reference numerals throughout, there is illustrated in FIG. 1 a game playing board 10 having a rectangular planar playing surface divided into a center region 12 bordered on all four sides by four (4) side regions 14. The center region 12 includes a pictorial outline 16 of the United States of America and each of the fifty states and the District of Columbia. Three of the four side regions 14 are subdivided into a vote tallying region 18 and a winner's box 20. Each vote tallying region 18 is further divided into two popular vote tallying columns 22, 23 and two electoral vote tallying columns 24, 25. The vote tallying regions 18 are headed with a legend blocks 26, 28, 30 indicating Democratic, Republican, or Independent affiliation, respectively. The fourth side region, i.e., the base of the game board 10, is subdivided into two sections including a scoring grid 32 for initially storing electoral votes in a manner to be more fully described below, and is denoted by a legend block 34. The second section includes another card storing region 36 for initially storing popular vote cards also to be more fully described below, and is denoted by a legend block 38.

Referring now to FIG. 2, a cubic die 44 is used by each player for playing the game and includes the percentages 60%, 20%, 15% and 0% imprinted on four of its six faces 46, 48, 50 and 52, respectively. The fifth face 54 is imprinted with the legend WIN: ELECTORAL VOTE, 20% POPULAR VOTE. The sixth face 56 is imprinted with the legend WIN: 20% POPULAR VOTE, LOSE ELECTORAL VOTE. Preferably, one die 44 is provided for each player, each die 44 being color coded to a particular political party, i.e., red for Democratic, blue for Republican, white for Independent.

With reference now to FIG. 3, each of a set of 51 electoral vote cards 60 includes state-specific information imprinted on a face portion 62 affixed to a backing plate 64. Optionally, the backing plate 64 is permanently adhered to a magnetic sheet material 66 to be magnetically mounted to a magnetized form of the game board 10 for use in, for example, moving vehicles or other unsteady environments where the numerous playing cards would be readily dislodged by vehicular motion. The information to be imprinted on each electoral vote card 60 includes, but is not limited to, the name of one particular state or the District of Columbia, the number of electoral votes assigned to that particular voting jurisdiction, together with the legend ELECTORAL COLLEGE VOTES. A chart providing this state-specific information is provided in FIG. 6, and optionally may also be imprinted on the face of the game board 10 or made available in individual instruction sheets (not shown) to be distributed to each game player.

In like fashion, and with reference to FIG. 4, a set of 255 popular vote cards 70 includes state-specific information imprinted on a face portion 72 affixed to a backing plate 74 in a manner similar to that of the electoral vote cards 70. An optional backing plate 74 may be affixed to a magnetic sheet material 76 to be magnetically mounted to the magnetized form of the game board 10. The card set is divided into five per state and the District of Columbia. Each five card set is imprinted with the name of the respective voting jurisdiction and the legend POPULAR VOTE. Additionally, one card from the set is imprinted with the percentage 60%, two cards from the set are imprinted with the percentage 20%, and the last two cards from the set are imprinted with the percentage 15%. The cards 70 are distributed in the course of playing the game, as will be more fully described below.

Prior to playing the game 10, each player selects from a playing piece set 80, shown in FIG. 5, a playing piece representing one of the three major political parties and denoted by the first letter of the name of the party. In particular, playing piece 82 represents the Democratic party and in like manner, playing pieces 84, 86 represent the Republican and Independent parties, respectively. Optionally, each playing piece 82, 84, 86 may be color coded as described above to further distinguish between them.

PLAYING THE GAME

Each player selects a political party and chooses the corresponding playing piece from the playing piece set 80, and enters that playing piece at starting point A of the map, represented as the state of Maine. The players decide amongst themselves the playing order of the game, which may be chosen by rolling the die 44 and awarding the player with the highest percentage the first move. Ties are resolved by rerolling the die. Preparatory to beginning the game, the 255 popular vote cards are distributed in groups of five to each voting district delineated in the Popular Vote card storage region 36. In like manner, all electoral vote cards are laid out in tile fashion in the Electoral Vote card receiving region 32.

Starting with the State of Maine, all players roll their dice. The player with the highest roll wins the electoral vote for the State of Maine, and is awarded the electoral card 60 representing this victory, i.e., the player winning the state of Maine is awarded 4 electoral votes. The winning player is also awarded the popular vote card 70 of the same percentage reflected on the top-side of that player's die, and those cards 60, 70 are placed in that player's vote tallying columns 22, 24, respectively. In the case of a tied roll, those players who threw the tying roll once again roll their dice to determine the final distribution of popular votes, and the vote cards 70 corresponding to each player's percentage noted on the top face of each rolled die is distributed accordingly. A player who rolls side 54 wins the tie-breaker, unless at least two players both roll side 54, in which case the tied players roll again to determine the winner. Other player(s), if any, are no longer eligible to win the electoral vote for that state.

The player who rolls the highest percentage either as a result of the first roll of the die or successfully wins any tie-breaker wins the electoral vote for that state and collects the corresponding electoral vote card 60, together with the appropriately valued popular vote card 70. The game is played through each succeeding state along the path marked from A (Maine) to B (California). Playing pieces 82, 84, 86 are advanced to the state most recently won (electoral vote) by that party. Preferrably, the players should keep a running tally of their electoral and popular votes. The first player to accumulate at least 270 electoral votes wins the "White House," and collects a representative playing piece 100 which is located in the appropriate location on the game board before the game commences. In the event that there is no front-runner candidate based on the cumulative electoral vote, the players keep a running tally of their popular votes reflecting the popular vote tallied throughout the country. In the instance that there is no electoral winner, then the "Congress" votes for a president, i.e., all the players roll their die again and the winner of that roll wins the "White House." It will be appreciated that each player will remove his/her playing cards 60,70 from the appropriate card storing region 32, 36 and place them in the corresponding popular vote tallying columns 22, 23 and electoral vote tallying columns 24, 25, thereby providing a measure of the progress of the game. Optionally, each player is provided with a set of 51 magnetic markers, each corresponding to the color of that player's political party, i.e., the color of the corresponding playing piece 82, 84 or 86. The winning player places one marker on each state in which the electoral vote has been won by the corresponding political party, thereby visually depicting the distribution of states won by each political party as the game progresses. It will also be appreciated that an enhanced knowledge of the names and locations of the various states of the U.S.A. should be gained through use of this game 10 as a teaching tool, while also providing important lessons in the operation of the Electoral College and the American presidential election process.

Although a preferred embodiment of the game of the present invention has been described herein and fully illustrated by the drawing figures, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

I claim:

1. A method of playing a board game to be played by a plurality of players, comprising the steps of:

(a) providing a game playing board having a game playing region representing a plurality of voting jurisdictions in which votes are cast recorded for a plurality of political parties each representing a candidate for the Presidency of the United States of America;

(b) providing a die having a numerical percentage affixed to each of its faces, at least two of said faces having different numerical percentages;

(c) rolling the die and assessing a percentage rolled by each player;

(d) comparing the rolled percentages and awarding all of the electoral votes corresponding to a first voting jurisdiction to the player who rolled the highest percentage;

(e) repeating steps (c) and (d) for another voting jurisdiction and determining a total number of electoral votes awarded to each player;

(f) concluding the game when at least one player has been awarded at least 270 electoral votes.

2. The method of playing a board game of claim 1, further comprising the steps of:

providing a set of electoral vote scoring pieces each bearing a name of a selected voting jurisdiction and a number of electoral votes corresponding to that voting jurisdiction; and awarding a corresponding electoral vote scoring piece to the player who rolled the highest percentage in step (d).

3. The method of playing a board game as claimed in claim 2, comprising the step of:

providing a plurality of electoral vote scoring piece receiving regions on the game board for receiving the electoral vote scoring pieces.

4. The method of playing a board game of claim 1, further comprising the steps of:

providing a set of popular vote scoring pieces each bearing a name of a selected voting jurisdiction and a percentage popular vote; and awarding to each player a popular vote scoring piece corresponding to the percentage assessed in step (c).

5. The method of playing a board game of claim 4, further comprising the step of providing for each popular vote scoring piece of each set a different percentage selected from the group 0%, 15%, 20%, and 60%.

6. The method of playing a board game as claimed in claim 4, comprising the step of:

providing a plurality of popular vote scoring piece receiving regions on the game board for receiving the popular vote scoring pieces.

7. The method of playing a board game of claim 1, comprising the additional step of providing each face of the die with a percentage selected from the group 0%, 15%, 20%, and 60%.

8. The method of playing a board game of claim 7, comprising the additional step of providing one of said die faces with an additional playing instruction.

9. The method of playing a board game of claim 1, comprising the steps of:

assigning a game piece to each player and introducing said game pieces to the first voting jurisdiction marked on said game board; and advancing each game piece from the first voting jurisdiction to the next voting jurisdiction won by the corresponding player.

10. The method of playing a board game as claimed in claim 1, comprising the step of providing a path connecting together all of the voting jurisdictions, said path commencing at the state of Maine and concluding at the state of California.

* * * * *